US011853007B2

(12) United States Patent
Comment

(10) Patent No.: US 11,853,007 B2
(45) Date of Patent: Dec. 26, 2023

(54) HOROLOGICAL COMPONENT INTENDED TO RECEIVE A MEMBER DRIVEN IN IT

(71) Applicant: ROLEX SA, Geneva (CH)

(72) Inventor: Dany Comment, Geneva (CH)

(73) Assignee: ROLEX SA, Geneva (CH)

( * ) Notice: Subject to any disclaimer, the term of this patent is extended or adjusted under 35 U.S.C. 154(b) by 420 days.

(21) Appl. No.: 17/003,936

(22) Filed: Aug. 26, 2020

(65) Prior Publication Data

US 2021/0063967 A1 Mar. 4, 2021

(30) Foreign Application Priority Data

Aug. 27, 2019 (EP) ..... 19193852

(51) Int. Cl.
*G04B 15/14* (2006.01)

(52) U.S. Cl.
CPC ..... *G04B 15/14* (2013.01)

(58) Field of Classification Search
CPC ..... G04B 15/14
See application file for complete search history.

(56) References Cited

U.S. PATENT DOCUMENTS

| | | | |
|---|---|---|---|
| 2,995,019 | A | 8/1961 | Stamm |
| 8,206,029 | B2 | 6/2012 | Vaucher et al. |
| 9,903,049 | B2 | 2/2018 | Ching et al. |
| 10,474,104 | B2 | 11/2019 | Helfer et al. |

(Continued)

FOREIGN PATENT DOCUMENTS

| | | | |
|---|---|---|---|
| CH | 700024 | B1 | 6/2010 |
| EP | 1580624 | A2 | 9/2005 |

(Continued)

OTHER PUBLICATIONS

European Search Report and Written Opinion dated Feb. 10, 2020 in counterpart application No. EP19193852; w/ English machine translation (total 14 pages).

*Primary Examiner* — Edwin A. Leon
*Assistant Examiner* — Kevin Andrew Johnston
(74) *Attorney, Agent, or Firm* — Seckel IP, PLLC

(57) ABSTRACT

Horological component (100) having a first opening (1) intended to receive a member (20) driven into the first opening, the component having an axis (A1; 1A1) centered in the first opening and at least two structures (10; 110) intended to receive the member, each comprising a receiving element (4*b;* 14*b*) intended to come into contact with the member and extending at least substantially orthoradially relative to the axis (A1; 1A1), a first connecting element (4*c;* 14*c*) extending at least substantially radially relative to the axis (A1; 1A1) from a first end of the receiving element, a second connecting element (4*d;* 14*d*) extending at least substantially radially relative to the axis (A1; 1A1) from a second end of the receiving element, a first elastically deformable element (4*a;* 14*a*) extending at least substantially orthoradially relative to the axis (A1; 1A1), and a second elastically deformable element (4*a'*; 14*a'*) extending at least substantially orthoradially relative to the axis (A1; 1A1), the first connecting element mechanically connecting the first end of the receiving element to the first elastically deformable element and the second connecting element mechanically connecting the second end of the receiving element to the second elastically deformable element.

20 Claims, 6 Drawing Sheets

(56) References Cited

U.S. PATENT DOCUMENTS

| | | | | |
|---|---|---|---|---|
| 2005/0217169 | A1* | 10/2005 | Kunz | G04B 13/025 47/33 |
| 2009/0154303 | A1 | 6/2009 | Vaucher et al. | |
| 2014/0313869 | A1* | 10/2014 | Cattiau | G04B 37/0091 368/281 |
| 2016/0147195 | A1* | 5/2016 | Charbon | C22C 38/38 368/140 |
| 2016/0238994 | A1 | 8/2016 | Ching et al. | |
| 2017/0269550 | A1* | 9/2017 | Calame | G04B 13/023 |
| 2018/0120769 | A1 | 5/2018 | Helfer et al. | |

FOREIGN PATENT DOCUMENTS

| | | | | |
|---|---|---|---|---|
| EP | 1826634 | A1 | 8/2007 | |
| EP | 2219083 | A1 * | 8/2010 | G04B 13/021 |
| EP | 2219083 | A1 | 8/2010 | |
| EP | 3056948 | A1 | 8/2016 | |
| FR | 1222456 | A | 6/1960 | |
| JP | 2006071503 | A * | 3/2006 | |
| JP | 2006071503 | A | 3/2006 | |
| JP | 2012185128 | A * | 9/2012 | |
| JP | 2012185128 | A | 9/2012 | |
| WO | 2012079976 | A1 | 6/2012 | |
| WO | 2016192957 | A1 | 12/2016 | |

* cited by examiner

HOROLOGICAL COMPONENT INTENDED TO RECEIVE A MEMBER DRIVEN IN IT

This application claims priority of European patent application No. EP19193852.1 filed Aug. 27, 2019, the content of which is hereby incorporated by reference herein in its entirety.

The invention concerns a horological component intended to receive a member driven into it. The invention also concerns an assembly comprising a component of this kind and a member mounted in or driven into the component. The invention further concerns a movement comprising a component of this kind or an assembly of this kind. The invention finally concerns a timepiece, in particular a watch, comprising a movement of this kind or an assembly of this kind or a component of this kind.

The process of assembling some wheels, in particular escape wheels, that have the particular feature of being manufactured by the LIGA process from an alloy based on nickel, constitutes a way to improvement with regard to its robustness and its repeatability.

The prior art discloses a multitude of elastic structure geometries conformed to enable driving of a horological component that is generally of a fragile kind onto a shaft. Structures of this kind are usually conformed with the objective of maximizing the clamping forces on the shaft whilst minimizing the driving in forces. Such structures may for example comprise elastic arms designed to be actuated in bending when driving in the shaft.

By way of example, the patent applications CH700024, WO2012079976, EP1826634 respectively disclose a collet of a spiral spring and wheels each comprising an elastic structure having a plurality of elastic arms built in at only one of their ends. A structure of this kind, characterized by an open or discontinuous contour, can prove particularly fragile and brittle. Moreover, the clamping forces expected may be low.

Alternatively, elastic structures of this kind may for example have a closed or continuous contour. By way of example the patent applications WO2016192957 and EP3056948 disclose collets respectively having three elastic arms and four elastic arms that project inward from a first, main opening intended to receive the shaft so as to come into contact with the shaft during the driving in operation. These collets, with three or four lobes, each comprise second openings that are open toward the first, main opening. They are conformed so as to maximize the active length of the elastic arms, defining points at which the elastic arms are built in as far as possible from the center of the first, main opening. During the operation of driving in the shaft, the bearing points on the shaft are moved radially relative to the geometrical axis of the shaft by the effect of the bending of each of the elastic arms. The clamping force is primarily produced by the stiffness of each of the arms, which here is defined by the height and the thickness of the collet. A geometry of this kind therefore imposes limitations.

For its part, the Japanese application JP2012185128 discloses an elastic structure comprising second openings taking the form of slots that are open toward a first opening intended to receive a shaft. The extent of these slots defines, in conjunction with third openings taking the form of portions of circular rings, the extent of elastic arms designed to come into contact with a shaft. In other words, the areas in which the elastic arms are built in are defined by the second openings and not exclusively by the third openings.

The out-of-round problem liable to be generated by elastic structures of this kind is mentioned in the patent application EP2219083. To overcome this problem, that patent application proposes to employ an elastic structure close to that disclosed by the application JP2012185128. This elastic structure, described in an escape wheel, also comprises second openings taking the form of slots that are open toward a first opening intended to receive a shaft. The extent of these slots defines, in conjunction with third openings taking the form of portions of circular rings, the extent of elastic arms designed to come into contact with a shaft. In order to minimize the deformation of the felloe of this wheel, the elastic structure further comprises fourth openings taking the form of multiple oblong slots with different extents disposed at the interface of the second and third openings and of the teeth of the escape wheel. Here the fourth openings are designed to be deformed and thus to absorb the deformations induced by the deformation of the elastic arms. The esthetic of the escape wheel is defined by the geometry of the elastic structure, which here occupies the major part of the plate of the escape wheel. An elastic structure of this kind is therefore difficult to transpose to a predefined horological component esthetic. It is also difficult to transpose to a horological component whatever its size.

The object of the invention is to provide a horological component making it possible to remedy the aforementioned disadvantages and to improve horological components known from the prior art. In particular, the invention proposes a horological component making it possible to offer high strength whilst avoiding deformation of the outside periphery of the component when driving it in.

A horological component according to aspects of the invention is defined by point 1 below.

1. A horological component comprising a first opening intended to receive a member when the latter is driven into the first opening, the component comprising an axis centered in the first opening and at least two structures intended to receive the member, each receiving structure comprising:
   - a receiving element intended to come into contact with the member and extending at least substantially orthoradially relative to the axis,
   - a first connecting element extending at least substantially radially relative to the axis from a first end of the receiving element,
   - a second connecting element extending at least substantially radially relative to the axis from a second end of the receiving element,
   - a first elastically deformable element extending at least substantially orthoradially relative to the axis, and
   - a second elastically deformable element extending at least substantially orthoradially relative to the axis, the first connecting element mechanically connecting the first end of the receiving element to the first elastically deformable element and the second connecting element mechanically connecting the second end of the receiving element to the second elastically deformable element.

Various embodiments of the component are defined by points 2 to 12 below.

2. The horological component as defined in the preceding point, comprising two or three or four structures intended to receive the member and/or wherein the receiving structures constitute an assembly having an Nth order symmetry of rotation with N=2 or N=3 or N=4.
3. The horological component as defined in any one of the preceding points, conformed so that when the member is introduced into the first opening the elastically deformable elements are mainly loaded in bending and/or the connecting elements are mainly loaded in compression and/or the receiving elements are mainly loaded in bending.

4. The horological component as defined in any one of the preceding points, comprising second openings extending at least substantially radially relative to the axis and opening into the first opening, each second opening defining orthoradially two receiving elements of two adjacent receiving structures and/or each second opening separating a first connecting element from a second connecting element of two adjacent receiving structures.
5. The horological component as defined in any one of the preceding points, wherein the same elastically deformable element constitutes the first elastically deformable element and the second elastically deformable element of two adjacent receiving structures.
6. The horological component as defined in any one of the preceding points, wherein the first elastically deformable element and/or the second elastically deformable element has a beam structure built in at only one of its ends.
7. The horological component as defined in any one of the preceding points, comprising third openings each comprising a first portion extending at least substantially orthoradially relative to the axis, a second portion extending at least substantially orthoradially relative to the axis and a third portion extending at least substantially radially relative to the axis.
8. The horological component as defined in the preceding point, wherein the first portion defines radially relative the axis an elastically deformable element and/or the second portion defines radially relative to the axis a receiving element and/or the third portion defines orthoradially relative the axis a connecting element.
9. The horological component as defined in any one of the preceding points, wherein a first cylinder having a first diameter is inscribed in the first opening and the second openings are inscribed in a second cylinder having a second diameter, the value of the second diameter being between 1.1 times and 3 times the value of the first diameter.
10. The horological component as defined in any one of the preceding points, wherein the receiving element comprises at least one surface or one linear bearing zone intended to come into contact with the member.
11. The horological component as defined in any one of the preceding points, produced by an electroforming process or a LIGA type process or a photolithography and deep etching process and/or made of a fragile material or of Ni or of NiP or of Si or of diamond or of quartz.
12. The horological component as defined in any one of the preceding points, comprising a hub the outside diameter of which is less than 2 mm or less than 1.5 mm or less than 1.2 mm, the receiving structures being mechanically connected to the hub, to the interior of the hub.

An assembly according to aspects of the invention is defined by point 13 below.

13. An assembly comprising a horological component as defined in any one of the preceding points and a member, the member being in particular mounted in or driven into the opening.

A movement according to aspects of the invention is defined by point 14 below.

14. A horological movement comprising a component as defined in any one of points 1 to 12 or an assembly as defined in point 13.

A timepiece according to aspects of the invention is defined by point 15 below.

15. A timepiece, in particular a watch, in particular a wristwatch, comprising a movement as defined in the preceding point or an assembly as defined in point 13 or a component as defined in any one of points 1 to 12.

The appended drawings represent by way of example a plurality of embodiments of a horological component according to the invention.

Figure 1:
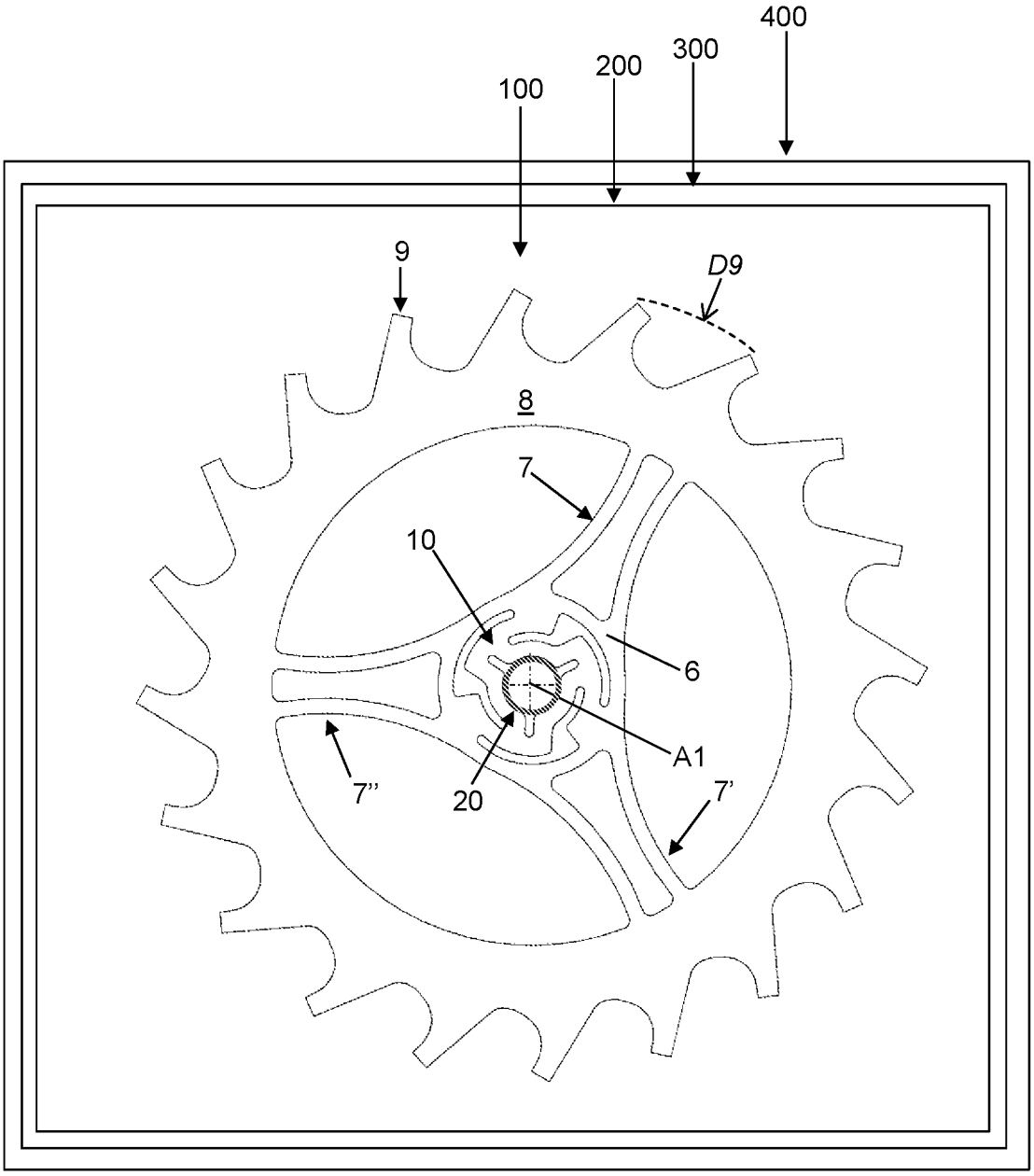
FIG. 1 is a view of a first embodiment of a timepiece including a first horological component embodiment.
Figure 2:
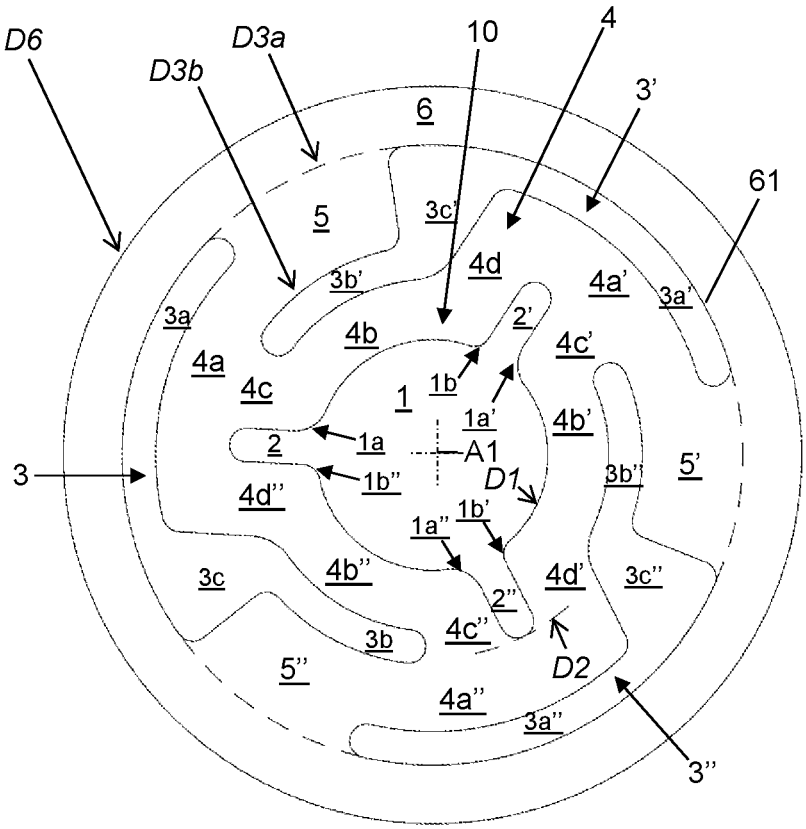
FIGS. 2 and 3 are detail views of the first horological component embodiment.
Figure 3:
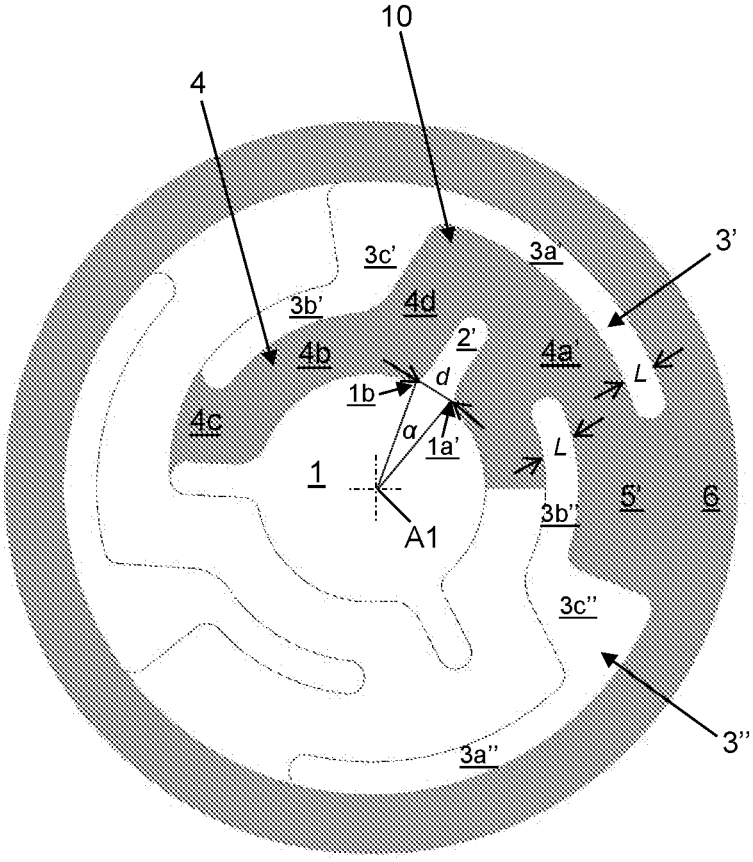

A first embodiment of a timepiece 400 according to the invention is described hereinafter with reference to FIGS. 1 to 4C. The timepiece is for example a watch, such as a wristwatch.

The timepiece comprises a horological movement 300. The horological movement may be mechanical, in particular automatic. The movement may alternatively be electronic.

The movement comprises an assembly 200 including a horological member 20 and a first horological component embodiment 100, the horological member 20 being mounted in, in particular driven into, the horological component 100.

The horological component comprises a first opening 1 intended to receive the member 20 when the latter is driven into said opening.

The member, in particular a part of the member intended to be driven into the horological component, may be made of a fragile material, in particular ceramic or ruby. The member part may be a shaft, in particular a shaft of cylindrical or substantially cylindrical shape.

In the first embodiment, the component 100 is an escape wheel. The component 100 may be a wheel of another type or the component 100 may be of another kind. In the first embodiment the escape wheel 100 may have an outside diameter D6 of the hub 6 that is advantageously less than D9/2, or even less than D9/3, or even less than D9/4, where D9 is the head diameter of teeth 9 disposed on a felloe 8 of the wheel 100.

The horological component and the member are represented in section in the figures, in particular in section on a plane perpendicular to a direction or to an axis A1 in or along which the member is driven into the component.

The horological component 100 comprises the first opening 1 intended to receive the member 20 when the latter is driven into the first opening. The axis A1 is centered in the first opening. The horological component 100 comprises at least two structures 10 intended to receive the member.

Each receiving structure comprises:

- a receiving element 4*b* intended to come into contact with the member and extending at least substantially orthoradially relative to the axis A1,
- a first connecting element 4*c* extending at least substantially radially relative to the axis A1 from a first end of the receiving element,
- a second connecting element 4*d* extending at least substantially radially relative to the axis A1 from a second end of the receiving element,
- a first elastically deformable element 4*a* extending at least substantially orthoradially relative to the axis A1, and a second elastically deformable element 4*a*' extending at least substantially orthoradially relative to the axis A1.

The first connecting element mechanically connects the first end of the receiving element to the first elastically deformable element and the second connecting element mechanically connects the second end of the receiving element to the second elastically deformable element.

The receiving element 4*b* comprises a bearing zone extending between two ends 1*a*, 1 *b* of the receiving element 4*b*, in particular from a first end 1*a* to a second end 1*b*. This bearing zone is intended to come into contact with the member 20, in particular into contact with a shaft of the member. These ends are defined by intersections of the first opening 1 and second openings 2, 2". The bearing zone may comprise a single continuous surface. Alternatively, the bearing zone may comprise a plurality of surfaces, in particular a plurality of elongate surfaces, in particular surfaces elongate parallel to the axis A1. Thus the receiving element comprises at least one surface or one point of contact intended to come into contact with the member. The receiving element 4*b* preferably comprises a first lineic or linear bearing zone extending for example parallel to the axis A1 at the level of a first end 1*a* of the receiving element 4*b* and a second lineic or linear bearing zone extending for example parallel to the axis A1 at a second end 1*b* of the receiving element 4*b*. Thus the first bearing zone and/or the second bearing zone has or have a line shape or a substantially line shape.

At rest, that is to say when no member is introduced into the opening, the first opening 1 has a substantially cylindrical geometry of diameter D1. This diameter D1 is the diameter of the cylinder of greatest diameter that can be inscribed in the opening. The axis A1 is defined as being the axis of revolution of this cylinder of greatest diameter. In this sense, the first opening 1 is centered on the axis A1.

When driving in the member 20, a geometrical axis A2 of the member, in particular the axis A2 of symmetry or of revolution of a shaft of the member 20, is designed to be aligned or substantially aligned with the geometrical axis A1 of the structure 10.

The horological component may comprise three structures 10 intended to receive the member. The receiving structures advantageously constitute an assembly having a third order symmetry of rotation. Consequently, only one receiving structure is described in detail here. The other receiving structures are deduced from the receiving structure described by rotations about the axis A1. An element of another structure that is similar to or that has the same function as an element of the receiving structure described is identified by the same reference number with the suffix ' or ".

The component is advantageously conformed so that when the member 20 is introduced into the first opening the elastically deformable elements are mainly loaded in bending and/or the connecting elements are mainly loaded in compression and/or the receiving elements are mainly loaded in bending.

The component advantageously comprises the second openings 2, 2', 2" extending at least substantially radially relative to the axis A1 and opening into the first opening. Each second opening also radially limits two receiving elements of two adjacent receiving structures and/or each second opening separates a first connecting element from a second connecting element of two adjacent receiving structures. The second openings 2 are for example slots extending radially relative to the axis A1 from the first opening 1. The depth of the slots (measured radially relative to the axis A1) is for example greater than twice the width of the slots (measured orthoradially to the axis A1).

The second openings 2, 2', 2" preferably have U shapes, that is to say with a rounded bottom, V shapes, that is to say with a lineic or substantially lineic bottom, or crenellation shapes, that is to say with a flat bottom. The second openings 2, 2', 2" are preferably inscribed in a cylinder of minimum diameter D2, with the diameter D2 between 1.1 times and 3 times the diameter D1 inclusive.

The width d of the openings (measured orthoradially relative to the axis A1) is preferably given by the equation $2\times d=\alpha\times D1$ with $\alpha$ between 0.17 and 0.7 inclusive.

In conjunction with the first and second openings, third openings 3, 3', 3" (opening neither into the first opening 1 nor into the second openings) enable definition of the geometries of the receiving structures.

The third openings mainly comprise a first opening portion 3*a* extending orthoradially or substantially orthoradially relative to the axis A1 at the level of a first diameter D3*a*, a second opening portion 3*b* extending orthoradially or substantially orthoradially relative to the axis A1 at the level of a second diameter D3*b* and a third opening portion 3*c* extending radially or substantially radially relative to the axis A1 from the first portion to the second portion, in particular from one end of the first portion to one end of the second portion.

The second diameter D3*b* is less than the first diameter D3*a*. For example, the diameters D3*b* and D3*a* may be related or substantially related by the following equation: $2\times D3b=D1+D3a$.

For example, the first portion 3*a* may extend over an angle of $1.5\times\pi/N$ around the axis A1, with N the number of receiving structures.

For example, the second portion 3*b* may extend over an angle of $0.8\times\pi/N$ around the axis A1, with N the number of receiving structures.

Alternatively, the first and second portions 3*a*, 3*b* may extend over the same or substantially the same angle around the axis A1.

The first elastically deformable element and/or the second elastically deformable element advantageously has or have a beam structure built in at only one of its ends at the level of the hub or at the level of second arms 5 connected to the hub.

The component advantageously comprises third openings 3 each comprising a first portion 3*a* extending at least substantially orthoradially relative to the axis A1, a second portion 3*b* extending at least substantially orthoradially relative to the axis A1 and a third portion 3*c* extending at least substantially radially relative to the axis A1.

The first portion 3*a* preferably defines radially relative to the axis A1 an elastically deformable element 4*a* and/or the second portion 3*b* preferably defines radially relative to the axis A1 a receiving element 4*b*" and/or the third portion 3*c* preferably defines orthoradially relative to the axis A1 a connecting element 4*d*".

This kind of geometry of the openings enables definition of an arm 4 comprising:

a first portion 4*a* of the arm 4, a second portion 4*c* of the arm 4, a third portion 4*b* of the arm 4, and a fourth portion 4*d* of the arm 4.

The first portion 4*a* is built into the second arm 5 extending from the hub 6, in particular from an internal surface 61 of the hub, in a direction radial or substantially radial relative to the axis A1. Here the building in is defined by two openings 3, 3', in particular by the portions 3*a*, 3*b*' and 3*c*'. More particularly, a section of the arm 4 at the level of its first portion 4*a* is defined by the diameters D3*a*, D3*b* and by the width L (measured radially relative to the axis A1) of the portions 3*a*, 3*b*'. The first portion 4*a* constitutes for example the aforementioned second elastically deformable element.

The second portion 4*c* extends radially or substantially radially relative to the axis A1 from the end of the first portion 4*a*. This second portion 4*c* is for example defined by the portion 3*b*' of the third opening 3' and by the opening 2. The second portion 4*c* constitutes for example the aforementioned second connecting element 4*c*. The portion 4*c* is a bend.

The third portion 4*b* extends orthoradially or substantially orthoradially relative to the axis A1 from the end of the second portion 4*c*. This third portion 4*b* is for example defined by the portion 3*b*' of the third opening 3' and by the opening 1. The third portion 4*b* constitutes for example the aforementioned receiving element 4*b*. The section of the arm 4 at the level of its third portion 4*b* is defined by the diameters D3*b* and D1 and by the width L of the portion 3*b* (measured radially).

The fourth portion 4*d* extends radially or substantially radially relative to the axis A1 from one end of the third portion 4*b*. This fourth portion 4*d* is for example defined by the portion 3*c*' of the third opening and by the opening 2'. The fourth portion 4*d* constitutes for example the aforementioned first connecting element 4*d*.

The fourth portion 4*d* is advantageously joined to the first portion 4*a*' of an adjacent arm 4'. This first portion 4*a*' of the adjacent arm 4' advantageously constitutes the aforementioned first elastically deformable element 4*a*'. Accordingly, in this preferred configuration, the same elastically deformable element 4*a* constitutes the first elastically deformable element and the second elastically deformable element of two adjacent receiving structures.

When assembling the member 20 the receiving elements 4*b*, 4*b*' and 4*b*" are adapted to be moved relative to the axis A1. To this end, the shaft of the member 20 comprises a portion 20*a* the format of which, in particular the diameter D20*a* of which, is greater than the format, in particular the diameter D1 of the first opening 1. Insertion of the portion 20*a* into the opening 1 therefore induces movement of the bearing zones relative to the axis A1. More particularly, the bending of the elastic arms 4, 4', 4" combined with the expansion of the second openings 2, 2', 2" advantageously induces movements of the receiving elements in radial and orthoradial directions with respect to the axis A1 without deformation of the rest of the horological component 100, in particular without deformation of the hub 6.

The clamping forces on the shaft 20 are advantageously defined mainly by the geometry of the second openings 2, 2' while the stresses applied to the hub 6 are minimized by the conformation of the first arm 4 and therefore the geometries of the two third openings 3, 3'.

In the first embodiment shown in FIGS. 1 to 4 all of the receiving structures 10 have a third order symmetry with respect to the axis A1. Thus all of the receiving structures 10 comprise three second openings 2, 2', 2" and three first arms 4, 4', 4" equally distributed around the geometrical axis A1.

An arrangement of this kind makes it possible to maximize the number of elastic arms while minimizing their stiffness and therefore to minimize the stresses in the material constituting the arms for a given opening geometry. An arrangement of this kind therefore makes it possible to minimize the stresses in the receiving structures 10 for a given clamping force on the shaft of the member 20.

Figure 4A:
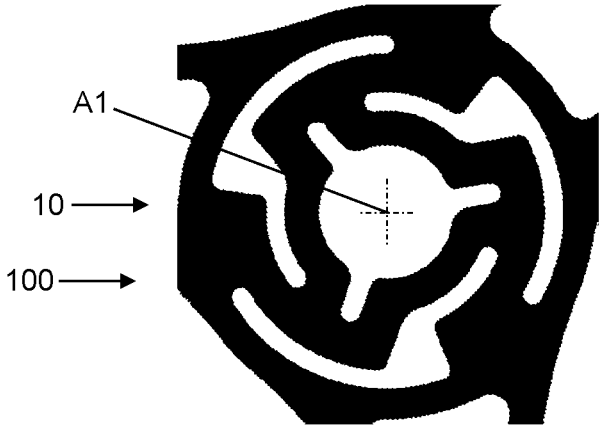
FIGS. 4A to 4C are detail views of the first embodiment of the horological component shown at different stages of assembly.
Figure 4B:
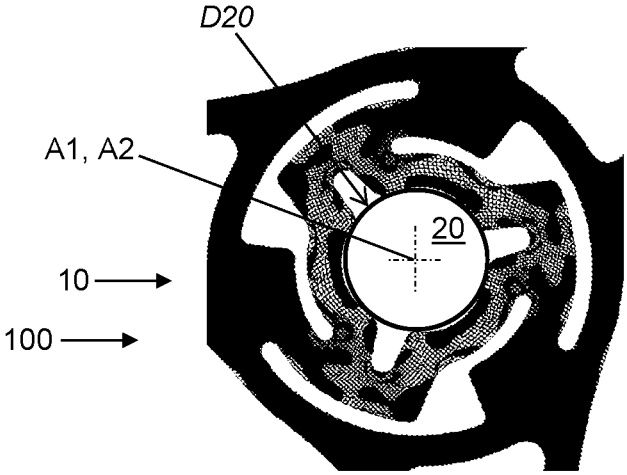
Figure 4C:
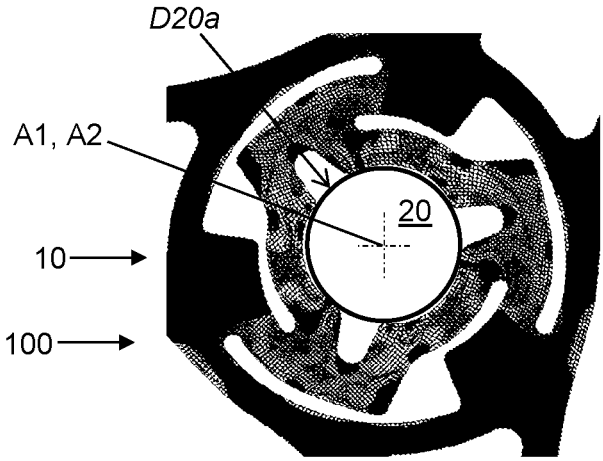

FIGS. 4A, 4B and 4C show the distribution of the stresses in the receiving structures 10 during steps of assembling the member 20 into the horological component 100. FIG. 4A represents the horological component in the rest state, that is to say not loaded by contact with the horological component. Here the structures 10 are entirely colored black, which indicates a zero level of stresses in the material constituting the structures 10.

FIG. 4B shows an intermediate assembly stage in which a portion of the horological component 20 comes into contact with the receiving elements 4*b*, 4*b*" and 4*b*" to move them in radial and orthoradial directions with respect to the axis A1 by virtue of the effect of an increase from the diameter D20 to the diameter D20*a* as the shaft 20 is introduced into the opening 1. The white cross-hatching expresses levels of stress induced by the expansion of the three second openings 2, 2', 2" and by the bending of the three arms 4, 4', 4". Note that the level of stress in the hub 6 is not impacted by the elastic deformation of the openings 2, 2', 2" and that of the arms 4, 4', 4".

FIG. 4C shows the horological component 100 once the member 20 has been completely inserted into it. It is seen that, despite propagation of the stresses in the arms 4, the hub 6 is not or not very much impacted. It follows that the hub is not deformed. The periphery or felloe of the wheel is a fortiori not deformed.

The structures 10 therefore enable assembly of the member 20 into the component 100 without unwanted deformation of the hub, the arms, or the felloe of the component.

Figure 5:
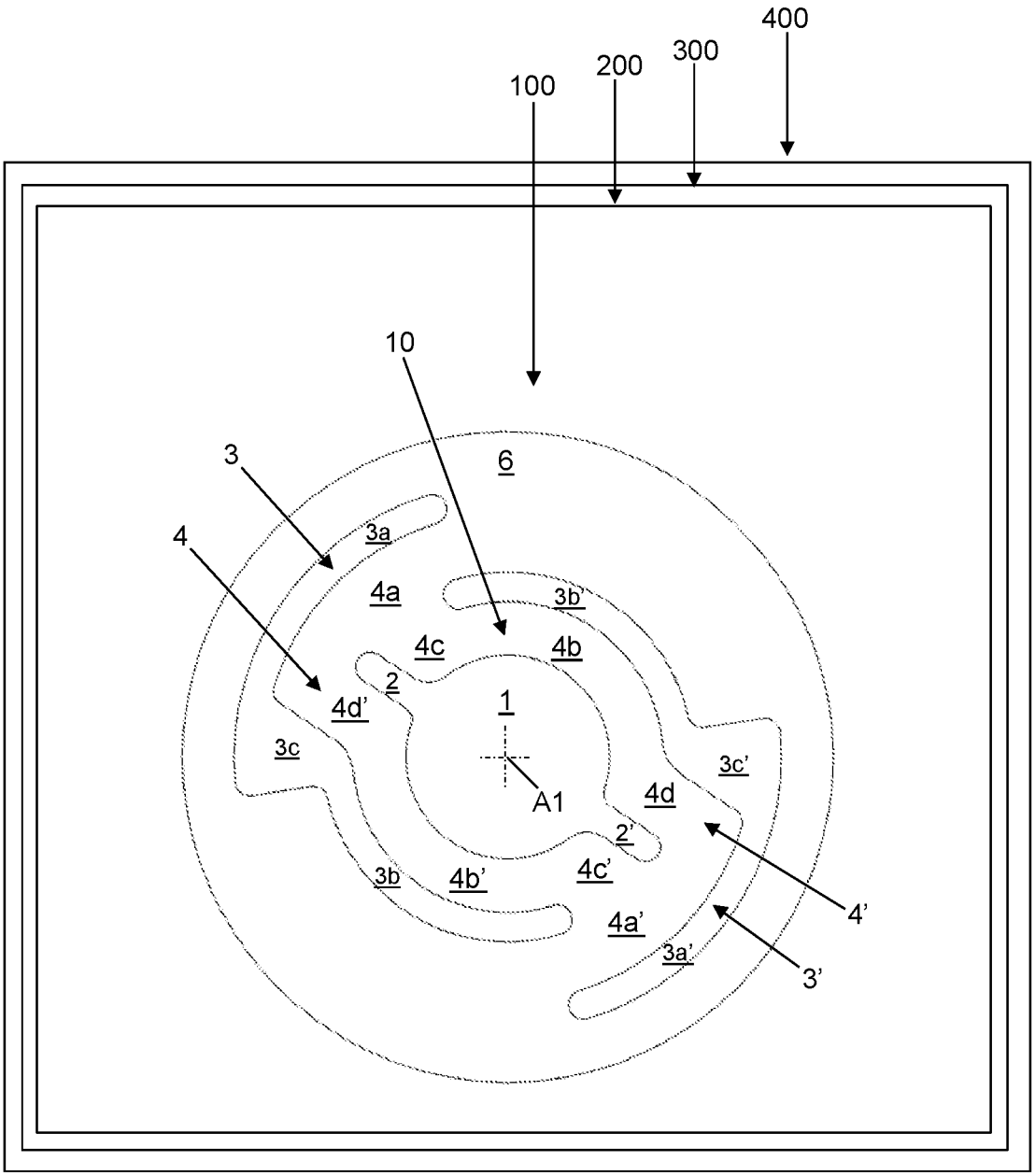
FIG. 5 is a view of a second embodiment of a timepiece including a second horological component embodiment.

A second embodiment of a timepiece 400 according to the invention is described hereinafter with reference to FIG. 5. The timepiece is for example a watch, such as a wristwatch.

The timepiece comprises a horological movement 300. The horological movement may be mechanical, in particular automatic. The movement may alternatively be electronic.

The movement comprises an assembly 200 including a horological member 20 and a second horological component embodiment 100, the horological member 20 being mounted in, in particular driven into, the horological component 100.

In this second embodiment the timepiece or the horological component does not differ from the timepiece of the first embodiment or from the horological component of the first embodiment for example except in that the horological component has only two receiving structures.

The assembly formed by the two receiving structures preferably has a second order symmetry of revolution.

Moreover, in this second embodiment, the horological component may have no second arm 5. In this case the first arms 4 may be mechanically connected directly to the hub 6.

A third embodiment of a timepiece 400 according to the invention is described hereinafter with reference to FIG. 6. The timepiece is for example a watch, such as a wristwatch.

The timepiece comprises a horological movement 300. The horological movement may be mechanical, in particular automatic. The movement may alternatively be electronic.

The movement comprises an assembly 200 including a horological member 20 and a third horological component embodiment 100, the horological member 20 being mounted in, in particular driven into, the horological component 100.

In this third embodiment the timepiece or the horological component differs from the timepiece of the first embodiment or the horological component of the first embodiment preferably only in that the horological component has four receiving structures for example.

The assembly formed by the four receiving structures preferably has a fourth order symmetry of revolution.

Moreover, in this third embodiment the timepiece or the horological component differs from the timepieces of the first and second embodiments or from the horological components of the first and second embodiments in that the third openings are duplicated.

In this third embodiment a receiving structural element that is similar to or has the same function as an element of the receiving structure of the first embodiment or of the second embodiment is identified by the same reference number to which an initial "1" is added.

Each receiving structure 110 comprises a first elastic arm 14 comprising a first portion 14*a* that is built into a second arm 15 extending from a hub 16 in a substantially radial direction relative to the axis 1A1 of the first opening 11. Here the building in is defined by two third openings 13*a*, 13*b*' each extending at least partly orthoradially relative to the axis 1A1. More particularly, the building in is defined here by respective portions 113*a*, 113*b*' of the openings 13*a*, 13*b*' each extending orthoradially relative to the axis 1A1. A section of the arm 14 at the level of its first portion 14*a* is defined by the diameters D13*a*, D13*b* and by the width L (measured radially relative to the axis 1A1) of the portions 113*a*, 113*b*'. Moreover, portions 113*b*' and 213*b*' of a third opening 13*b*' enable, in conjunction with the first and second openings 11 and 12', definition of the portions 14*b*, 14*c* and 14*d* of arms 14. The arm 14 therefore has a bent arm shape.

Figure 6:
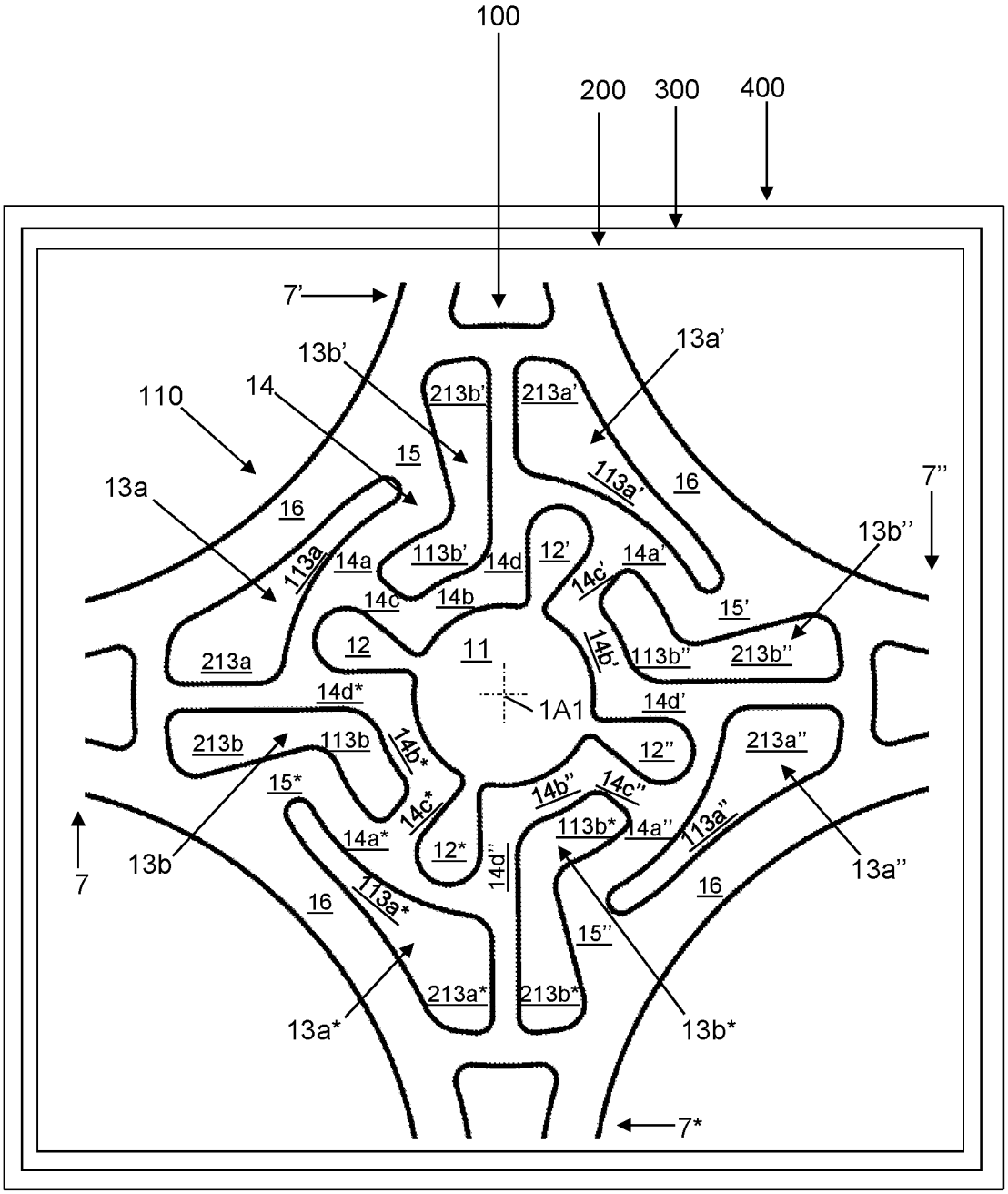
FIG. 6 is a partial detail view of a third embodiment of a timepiece including a third horological component embodiment.

In this third embodiment shown in FIG. 6 all of the receiving structures 110 have a fourth order symmetry of rotation relative to the axis 1A1 and the four first arms 14, 14', 14", 14* are equally distributed around the geometrical axis 1A1. The portions 14*a*, 14*a*', 14*a*", 14*a are driven into respective second arms 15, 15', 15", 15*. In this embodiment the respective portions 14***b*, 14*b*', 14*b*", 14*b of the arms 14, 14', 14", 14* are respectively built into the respective portions 14***a*, 14*a*', 14*a*", 14*a of the arms 14, 14', 14", 14* via the portions 14***c*, 14*c*', 14*c*" and 14*c**. In other words, the arms are interleaved with one another.

Regardless of the embodiment or the variant embodiment, the component may comprise two, three or four structures intended to receive the member and/or the receiving structures constitute an assembly having an Nth order symmetry of rotation with N=2 or N=3 or N=4.

Regardless of the embodiment or the variant embodiment, the horological component is preferably conformed so that when the member is introduced into the first opening the elastically deformable elements are mainly loaded in bending and/or the connecting elements are mainly loaded in compression and/or the receiving elements are mainly loaded in bending.

Regardless of the embodiment or the variant embodiment, the horological component preferably comprises second openings extending at least substantially radially relative to the axis and opening into the first opening, each second opening orthoradially limiting two receiving elements of two adjacent receiving structures and/or each second opening separating a first connecting element from a second connecting element of two adjacent receiving structures.

Regardless of the embodiment or the variant embodiment, the horological component preferably comprises one elastically deformable element constituting the first elastically deformable element and the second elastically deformable element of two adjacent receiving structures.

Regardless of the embodiment or the variant embodiment, the first elastically deformable element and/or the second elastically deformable element preferably has a beam structure built in at only one of its ends.

Regardless of the embodiment or the variant embodiment, the horological component preferably comprises third openings each comprising a first portion extending at least substantially orthoradially relative to the axis, a second portion extending at least substantially orthoradially relative to the axis and a third portion extending at least substantially radially relative to the axis.

Regardless of the embodiment or the variant embodiment, the first portion preferably defines radially relative to the axis an elastically deformable element and/or the second portion preferably defines radially relative to the axis a receiving element and/or the third portion preferably defines orthoradially relative to the axis a connecting element.

Regardless of the embodiment or the variant embodiment, a first circular cylinder having a first diameter is inscribed in the first opening and the second openings are inscribed in a second circular cylinder having a second diameter, the second diameter having a value between 1.1 times and 2.5 times the first diameter.

Regardless of the embodiment or the variant embodiment, the receiving element preferably comprises at least one surface or one point of contact intended to come into contact with the member.

Regardless of the embodiment or the variant embodiment, the first opening is inscribed in a first circular cylinder having a first diameter and the second openings are inscribed in a second circular cylinder having a second diameter, the second diameter varying between 1.1 times and 2.5 times the first diameter.

Regardless of the embodiment or the variant embodiment, the horological component may be produced by an electroforming process or by a LIGA type process or by a photolithography and deep etching process.

Regardless of the embodiment or the variant embodiment, the horological component may be made of a fragile material or of Ni or of NiP or of Si or of diamond or of quartz.

Regardless of the embodiment or the variant embodiment, the horological component may comprise a hub 6 the outside diameter of which is less than 2 mm or less than 1.5 mm or less than 1.2 mm, the receiving structures being mechanically connected to the hub, to the interior of the hub, that is to say to a surface facing toward the interior of the hub.

The sections of the structures are represented for the various embodiments. These sections may preferably be identical and oriented in the same manner in all the various section planes perpendicular to the axis A1, 1A1. Nevertheless, the sections may also evolve along the axis A1, 1A1. In particular, the sections may turn along the axis A1, 1A1 and helicoidal shapes can therefore be produced.

The horological component solutions described above therefore have elastic structures designed to receive a member such as a shaft. These structures have the specific feature of being particularly compact. For example, they may be disposed at the center of a horological component, in particular of a wheel, and be supported by a hub of small diameter.

Moreover, structures of this kind advantageously make it possible, when driving in the member, not to induce deformation of the external geometry of the horological component, such as the felloe, or deformation of the arms connecting the hub to the felloe. Moreover, because of their compactness, the structures have no effect on the esthetic or the geometry of the major part of the member, in particular the plate of the wheel. In particular, the structures have no effect on the esthetic or the geometry of arms connecting a hub to a wheel felloe. Thus structures of this kind may advantageously be implemented in a component, in particular a wheel, of predefined design.

The components described above are particularly suited to materials that have no or little plastic region.

The components described are in particular conformed so as substantially to minimize, or even to eliminate, any deformation of the rest of the horological component when a member is driven into the component. In practise such components enable, for example, robust, reliable and permanent assembly of an escape wheel onto a shaft, independently of any deformation of the arms or of the outside perimeter, in particular of the teeth, of said wheel risking generation of an out-of-round.

Moreover, the receiving structures of components of this kind have the advantage of being particularly compact and therefore easily integrated into a predefined horological component esthetic.

The horological components described are particularly suitable for axial mounting or driving on without or virtually without deformation of their perimeter caused by mounting them on a shaft.

In the present application by "an element extends in a first direction" is preferably meant that the element has a first dimension in that first direction which is at least greater than, or even at least twice, a second dimension in a second direction perpendicular to that first direction, the first and second directions being perpendicular to the axis A1, 1A1.

Instead or additionally, in the present application by "an element extends in a first direction" is meant that the element mechanically connects two spaced elements each extending or substantially extending in a second direction perpendicular to the first direction.

The invention claimed is:

1. A horological component comprising a first opening intended to receive a member when the latter is driven into the first opening, the component having an axis centered in the first opening, and at least two receiving structures intended to receive the member, each of the receiving structures comprising:

a receiving element adapted to come into contact with the member and extending at least substantially orthoradially relative to the axis between a first orthoradial end and a second orthoradial end of the receiving element, a first connecting element extending at least substantially radially relative to the axis from the first orthoradial end of the receiving element, a second connecting element separate from the first connecting element, the second connecting element extending at least substantially radially relative to the axis from the second orthoradial end of the receiving element, a first elastically deformable element extending at least substantially orthoradially relative to the axis, the first elastically deformable element allowing radial movement of the receiving element, and a second elastically deformable element separate from the first elastically deformable element, the second elastically deformable element extending at least substantially orthoradially relative to the axis, the second elastically deformable element allowing radial movement of the receiving element, wherein the first connecting element mechanically connects the first orthoradial end of the receiving element to the first elastically deformable element and the second connecting element mechanically connects the second orthoradial end of the receiving element to the second elastically deformable element, wherein first and second receiving structures of the at least two receiving structures are adjacent, wherein the second elastically deformable element of the first receiving structure constitutes the first elastically deformable element of the second receiving structure.

2. The horological component as claimed in claim 1, comprising two or three or four structures adapted to receive the member.

3. The horological component as claimed in claim 1, conformed so that when the member is introduced into the first opening, at least one of the following:

the elastically deformable elements are mainly loaded in bending, the connecting elements are mainly loaded in compression, the receiving elements are mainly loaded in bending.

4. The horological component as claimed in claim 1, comprising second openings extending at least substantially radially relative to the axis and opening into the first opening, wherein at least one of the following:

each of the second openings defines orthoradially the two receiving elements of two adjacent receiving structures among the at least two receiving structures, each second opening separates a first connecting element from a second connecting element of two adjacent receiving structures among the at least two receiving structures.

5. The horological component as claimed in claim 1, wherein at least one selected from the group consisting of the first elastically deformable element and the second elastically deformable element has a conformation of a beam built-in at only one of its ends.

6. The horological component as claimed in claim 1, comprising third openings each comprising a first portion extending at least substantially orthoradially relative to the axis, a second portion extending at least substantially orthoradially relative to the axis, and a third portion extending at least substantially radially relative to the axis.

7. The horological component as claimed in claim 6, wherein at least one of the following:

the first portion defines radially relative to the axis at least one of the elastically deformable elements, the second portion defines radially relative to the axis at least one of the receiving elements, the third portion defines orthoradially relative to the axis at least one of the connecting elements.

8. The horological component as claimed in claim 4, wherein a first cylinder having a first diameter is inscribed in the first opening and the second openings are inscribed in a second cylinder having a second diameter, the value of the second diameter being in a range of from 1.1 times to 3 times the value of the first diameter.

9. The horological component as claimed in claim 1, wherein the receiving element comprises at least one surface or one linear bearing zone adapted to come into contact with the member.

10. The horological component as claimed in claim 1, which has been produced by an electroforming process or a LIGA type process or a photolithography and deep etching process.

11. The horological component as claimed in claim 1, comprising a hub having an outside diameter of less than 2 mm, the receiving structures being mechanically connected to the hub.

12. An assembly comprising:

the horological component as claimed in claim 1, and a member mounted in or driven into the opening.

13. A horological movement comprising a component as claimed in claim 1.

14. A timepiece comprising the horological component as claimed in claim 1.

15. The horological component as claimed in claim 1, wherein the receiving structures constitute an assembly having an Nth order symmetry of rotation with N=2 or N=3 or N=4.

16. The horological component as claimed in claim 1, which is made of a fragile material or of Ni or of NiP or of Si or of diamond or of quartz.

17. The horological component as claimed in claim 11, wherein the hub has an outside diameter of less than 1.5 mm.

18. The horological component as claimed in claim 11, wherein the hub has an outside diameter of less than 1.2 mm.

19. The horological component as claimed in claim 11, wherein the receiving structures are mechanically connected to an interior of the hub.

20. A horological component comprising a first opening intended to receive a member when the latter is driven into the first opening, the component having an axis centered in the first opening, at least two receiving structures intended to receive the member, and a peripheral portion surrounding the first opening and the at least two receiving structures, each of the receiving structures comprising:

a receiving element adapted to come into contact with the member and extending at least substantially orthoradially relative to the axis between a first orthoradial end and a second orthoradial end of the receiving element, a first connecting element extending at least substantially radially relative to the axis from the first orthoradial end of the receiving element, a second connecting element separate from the first connecting element, the second connecting element extending at least substantially radially relative to the axis from the second orthoradial end of the receiving element, a first elastically deformable element extending at least substantially orthoradially relative to the axis between a first orthoradial end and a second orthoradial end of the first elastically deformable element, the first elastically deformable element allowing radial movement of the receiving element, and a second elastically deformable element separate from the first elastically deformable element, the second elastically deformable element extending at least substantially orthoradially relative to the axis between a first orthoradial end and a second orthoradial end of the second elastically deformable element, the second elastically deformable element allowing radial movement of the receiving element, wherein the first connecting element mechanically connects the first end of the receiving element to the first elastically deformable element and the second connecting element mechanically connects the second end of the receiving element to the second elastically deformable element, wherein the first elastically deformable element has a conformation of a first orthoradial beam built-in with the peripheral portion by a first radial built-in connection at only one of its orthoradial ends and not at the other of its orthoradial ends, and wherein the second elastically deformable element has a conformation of a first orthoradial beam built-in with the peripheral portion by a second radial built-in connection at only one of its orthoradial ends and not at the other of its orthoradial ends, the second radial built-in connection being separate from the first radial built-in connection.

* * * * *